US006037849A

United States Patent [19]

Ciezarek

[11] Patent Number: 6,037,849

[45] Date of Patent: Mar. 14, 2000

[54] MICROWAVE SWITCH HAVING MAGNETICALLY RETAINED ACTUATOR PLATE

[75] Inventor: Krzysztof J. Ciezarek, Calabria Camarillo, Calif.

[73] Assignee: Delaware Capital Formation, Inc., Wilmington, Del.

[21] Appl. No.: 09/360,662

[22] Filed: Jul. 26, 1999

[51] Int. Cl.[7] ..... H01H 53/00

[52] U.S. Cl. ..... 335/4; 335/5; 333/105

[58] Field of Search ..... 335/4, 5, 205–207, 335/104–106; 333/103–109

[56] References Cited

U.S. PATENT DOCUMENTS

| | | | |
|---|---|---|---|
| 3,487,342 | 12/1969 | Gibson et al. . | |
| 4,298,847 | 11/1981 | Hoffman . | |
| 4,633,118 | 12/1986 | Kosugi . | |
| 4,697,056 | 9/1987 | Hoffman . | |
| 5,063,364 | 11/1991 | Tsoi . | |
| 5,065,125 | 11/1991 | Thomson et al. . | |
| 5,281,936 | 1/1994 | Ciezarek | 335/4 |
| 5,724,014 | 3/1998 | Leikus et al. | 335/4 |

*Primary Examiner*—Lincoln Donovan
*Assistant Examiner*—Tuyen T. Nguyen
*Attorney, Agent, or Firm*—Nilles & Nilles, S.C.

[57] ABSTRACT

A microwave switch comprising a connection assembly which has multiple positions and a drive assembly which places the connection assembly into a selected one of the positions at a time. The microwave switch may, for example, be a microwave T-switch or another type of microwave switch. The drive assembly includes an actuator plate which is mechanically coupled to reeds of the connection assembly and places the connection assembly into the selected position. During operation of the switch, a magnetic force of the permanent magnet is substantially the only holding force that holds the actuator plate in place in at least one direction. In another aspect, the drive assembly further comprises multiple movable links which mechanically couple arms of the actuator plate to various reeds. Each movable link comprises first and second generally flat members. Within each respective one of the movable links, the first member and second members are spaced by different amounts from the actuator plate. In contrast, comparing the movable links to each other, each of the first members for each of the movable links are spaced from the actuator plate by approximately the same amount, and each of the second members for each of the movable links are spaced from the actuator plate by approximately the same amount.

21 Claims, 5 Drawing Sheets

MICROWAVE SWITCH HAVING MAGNETICALLY RETAINED ACTUATOR PLATE

BACKGROUND OF THE INVENTION

1. Field of the Invention

This invention relates to microwave switches and, in particular, relates to a microwave switch having a magnetically retained actuator plate.

2. Description of Related Art

Microwave switches are known for switching microwave signals. One type of microwave switch is the microwave T-switch, which is used to switch connections between four microwave signals received at four ports of the T-switch. In particular, the T-switch is used to allow each port to be connected to each of the three remaining ports, and has three different positions with two pairs of ports being connected in each position.

Referring to FIGS. 1A–1C, a schematic representation of the connection assembly of a typical T-switch 10 is illustrated. The T-switch 10 comprises a plurality of contacts 12-1, 12-2, 12-3 and 12-4 which are each connected to a respective one of four ports. The T-switch also comprises six reeds 14*a*–14*c* and 16*a*–16*c*. The reeds 14*a*–14*c* and 16*a*–16*c* are each generally formed of a flat, elongated member formed of, for example, gold-plated beryllium copper. At any given time, one of the outer reeds 14*a*–14*c* will be actuated and one of the inner reeds 16*a*–16*c* will be actuated, with the remaining reeds not being actuated.

In combination, therefore, the reeds 14*a*–14*c* and 16*b*–16*c* cooperate to give the T-switch 10 three unique positions, shown respectively in FIGS. 1A–1C. Thus, in a first position of the T-switch 10, shown in FIG. 1A, the reed 14*a* connects the contact 12-1 to the contact 12-2, and the reed 16*a* connects the contact 12-3 to the contact 12-4. (The reeds that are actuated and that establish connections between the contacts 12-1, 12-2, 12-3 and 12-4 are shown in solid black lines, and the reeds that are not actuated and that do not establish connections are shown in dashed lines.) In FIG. 1B, the reed 14*b* connects the contact 12-2 to the contact 12-4, whereas the reed 16*b* connects the contact 12-1 to the contact 12-3. Finally, in FIG. 1C, the reed 14*c* connects the contact 12-1 to the contact 12-4, whereas the reed 16*c* connects the contact 12-2 to the contact 12-3.

In order to allow the position of T-switches to be controlled automatically, T-switches are ordinarily provided with a drive assembly that is used to select between the various T-switch positions. Additionally, in order to allow the position of the switch to be determined electronically, T-switches are sometimes also provided with indicator assemblies which each typically comprise a switch that turns on when the T-switch is in a respective one of the three positions.

Microwave switches are widely used in space applications in which size and weight considerations are of premium importance. It is therefore desirable to provide a microwave switch with drive and indicator assemblies that are as small and as lightweight as possible, so that the overall size and weight of the microwave switch may be reduced.

BRIEF SUMMARY OF THE INVENTION

According to a first aspect of the invention, the invention provides a microwave switch comprising a connection assembly which has first, second and third positions and a drive assembly which places the connection assembly in a selected one of the first, second and third positions at a time. The microwave switch may, for example, be a microwave T-switch or another type of microwave switch.

The connection assembly includes a first contact, a second contact, a third contact, a first reed, a second reed, and a third reed. The first reed is connected to the first contact when the connection assembly is in the first position and is disconnected from the first contact when the connection assembly is in the second and third positions. Similarly, the second reed is connected to the second contact when the connection assembly is in the second position and is disconnected from the second contact when the connection assembly is in the first and third positions. Finally, the third reed is connected to the third contact when the connection assembly is in the third position and is disconnected from the third contact when the connection assembly is in the first and second positions.

The drive assembly includes a plurality of electromagnetic coils, a permanent magnet, and an actuator plate. The actuator plate has first, second and third positions that correspond to the first, second and third positions of the connection assembly. The actuator plate is mechanically coupled to the first, second and third reeds and actuates a selected one of the first, second and third reeds so as to place the connection assembly in a selected one of the first, second and third positions at a time. The actuator plate is itself placed into one of the first, second and third positions at a time by the plurality of electromagnetic coils and the permanent magnet.

In one aspect, the actuator plate defines a plane, and a normal axis is defined by an axis that is substantially perpendicular to the plane defined by the actuator plate. During operation of the switch, a magnetic force of the permanent magnet is substantially the only holding force that holds the actuator plate in place in the normal direction. The magnetic force of the permanent magnet is therefore required to hold the actuator plate in place in the normal direction.

In another aspect, the drive assembly further comprises first, second and third movable links. The first, second and third movable links mechanically couple the first, second and third arms of the actuator plate to the first, second and third reeds, respectively. Each movable link comprises first and second generally flat members that extend generally parallel to the plane. Within each respective one of the movable links, the first member is spaced from the actuator plate by a different amount than the second member. In contrast, comparing the movable links to each other, each of the first members for each of the movable links are spaced from the actuator plate by approximately the same amount, and each of the second members for each of the movable links are spaced from the actuator plate by approximately the same amount.

Advantageously, the preferred microwave switch is more lightweight and compact than other microwave switches that are currently available. The fact that the actuator plate is magnetically retained by a permanent magnet that is part of the drive assembly makes it unnecessary to provide separate support structure for the actuator plate. The simple actuation mechanism can be provided in a manner that is compact and lightweight. Additionally, the preferred arrangement for the movable links that mechanically couple the actuator plate to the reeds is also compact and further reduces the size of the preferred microwave switch.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 2:
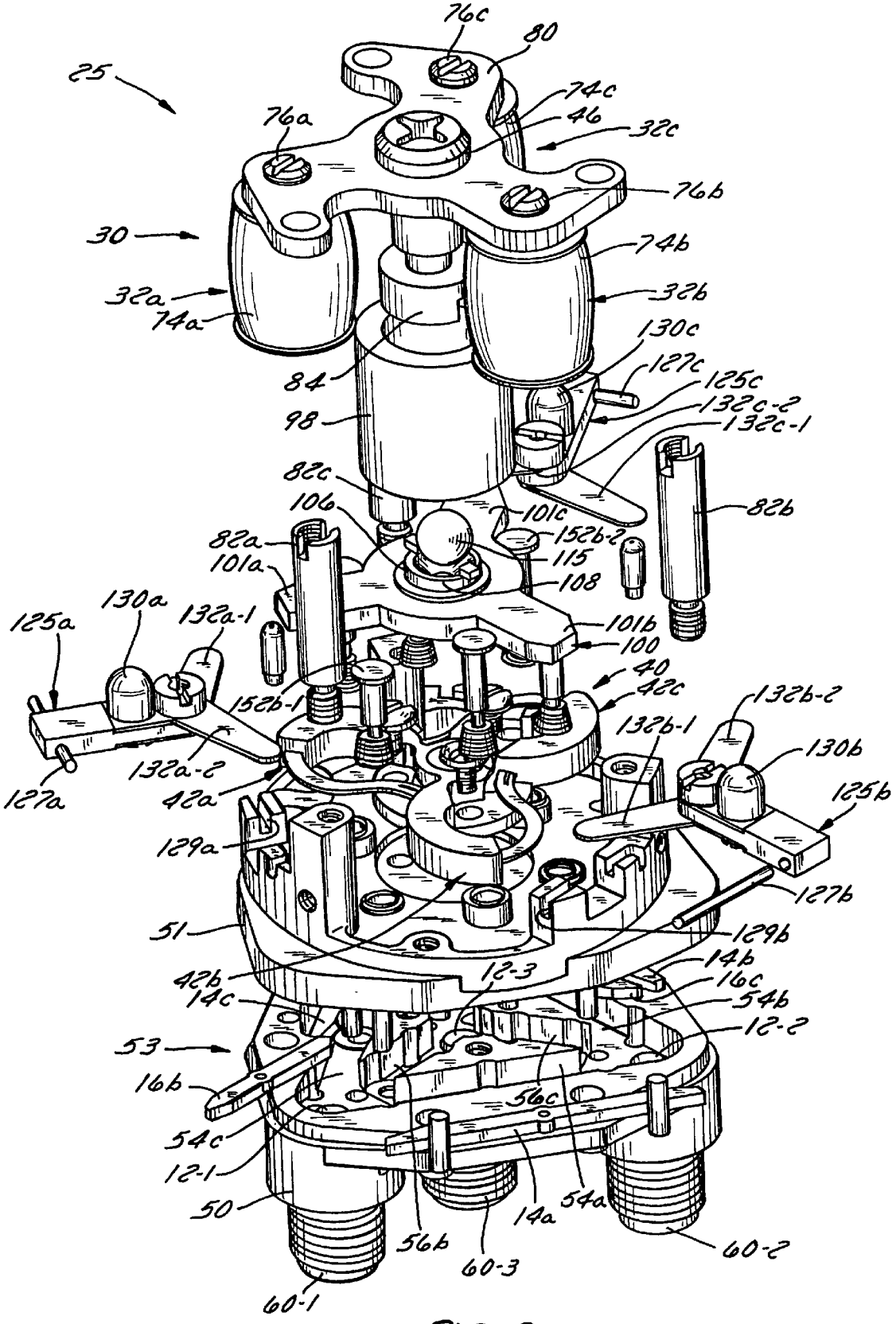
FIG. 2 is an exploded perspective view of a preferred embodiment of a microwave switch.

Referring now to FIG. 2, an exploded perspective view of a preferred embodiment of a microwave switch is illustrated. The switch is a microwave T-switch 25 and comprises a drive assembly 30, an indicator assembly 40 and a base 50.

The drive assembly 30 includes three drive sections 32, including drive section 32*a*, drive section 32*b* and drive section 32*c*. Similarly, the indicator assembly 40 includes three indicators 42, including indicator section 42*a*, indicator section 42*b* and indicator section 42*c*. Herein, for consistency and for ease of understanding, the letter "a" will be used in connection with structures that are part of, cooperate with, or are otherwise associated with, the drive section 32*a* (for example, the indicator section 42*a* cooperates with the drive section 32*a*.) The same convention will also be used with the letters "b" and "c" and the drive sections 32*b* and 32*c*. Additionally, structures that have the same reference numeral with different letters will sometimes be referred to collectively using only the reference numerals (for example, the indicators 42*a*, 42*b* and 42*c* will sometimes be referred to collectively as the indicators 42.)

Disposed within the base 50 is a connection assembly 53 comprising four contacts 12-1 to 12-4 and six reeds 14*a*–14*c* and 16*a*–16*c*. (The contacts 12 are more specifically designated the numbers 1, 2, 3 and 4 rather than with the letters a, b, and c because the contacts 12 are not associated with any particular drive section. The numbering and lettering for the reeds 14*a*–14*c* and 16*a*–16*c* is the same as in FIGS. 1A–1C and has been chosen so as to correctly correspond to the drive sections 32*a*, 32*b* and 32*c*, as described above.) In FIG. 2, only the contacts 12-1, 12-2 and 12-3 are illustrated. Additionally, only the reeds 14*a*, 14*b*, 16*a*, 18*a* and 18*b* are illustrated.

The reeds 14 and 16 fit within channels 54 and 56, respectively, formed in the base 50. The contacts 12-1, 12-2 and 12-3 are each connected to respective ports which, in the illustrated embodiment, are a plurality of coaxial connectors 60-1, 60-2, and 60-3 mounted at the bottom of the base 50. A fourth coaxial connector associated with the contact 12-4 is not shown. The contacts 12 are connected to the inner (signal) wire of each respective coaxial cable, with the outer shielding of the coaxial cables being connected to the base 50.

Figure 1C:
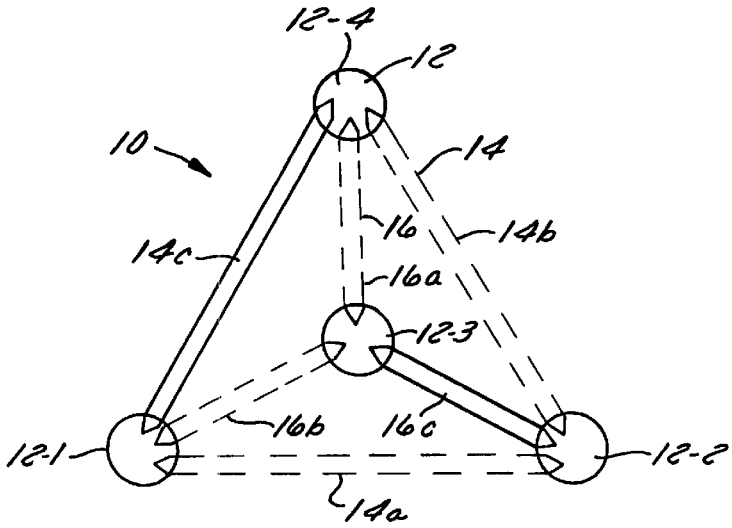
FIGS. 1A–1C are schematic representations of the connection assembly of a typical microwave T-switch.
Figure 1A:
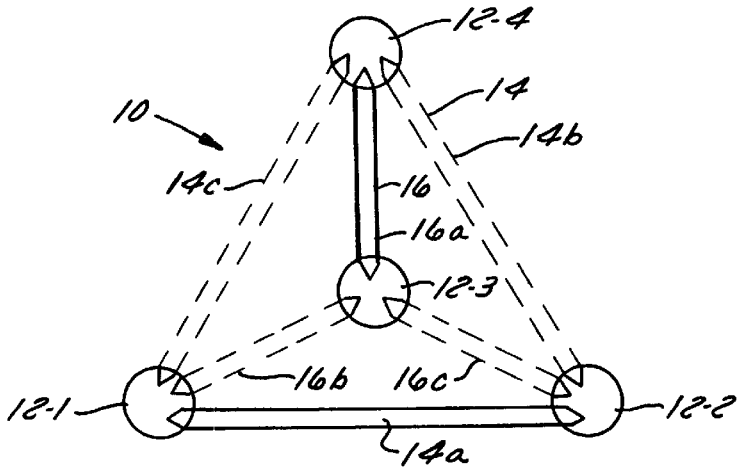
Figure 1B:
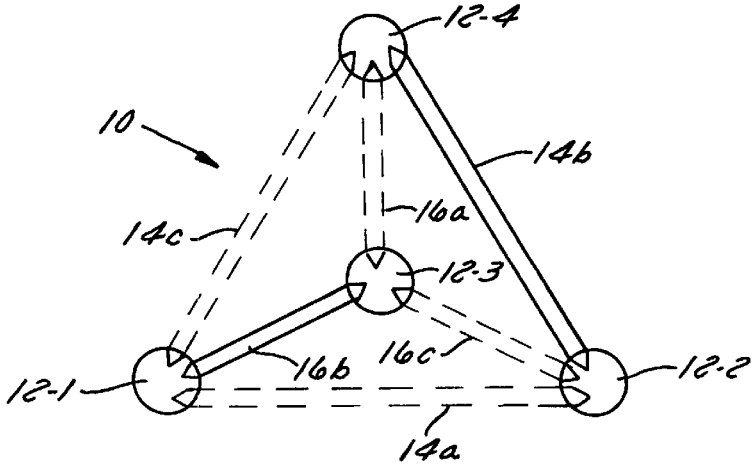

The switch 25 is a microwave T-switch and has, therefore, as previously discussed in connection with FIGS. 1A–1C, three unique positions. In any given position, one of the outer reeds 14*a*–14*c* is pushed downwardly against two of the three contacts 12-1, 12-2 and 12-4, and one of the inner reeds 16*a*–16*c* is pushed downwardly against the contact 12-3 and one of the three remaining contacts 12-1, 12-2 and 12-4. To this end, each of the reeds 14 and 16 is provided with a return spring (not illustrated) which returns the reed to a lifted position when the reed is not pushed downwardly by the drive assembly 30.

The drive sections 32*a*–32*c* each comprise respective drive coils 74*a*–74*c*. Respectively mounted within the coils 74*a*–74*c* are a plurality of magnetic cores 76*a*–76*c* (only the mounting screw of the magnetic cores 76 is visible in FIG. 2). The coils 74 and the cores 76 are mounted to a coil plate 80, which is preferably formed of iron so as to be magnetically conductive. The coil plate 80 is mounted to an upper portion 51 of the base 50 by a plurality of standoffs 82*a*–82*c*, which are located physically adjacent the drive coils 76*a*–76*c*, respectively, when the switch 25 is assembled.

Figure 3:
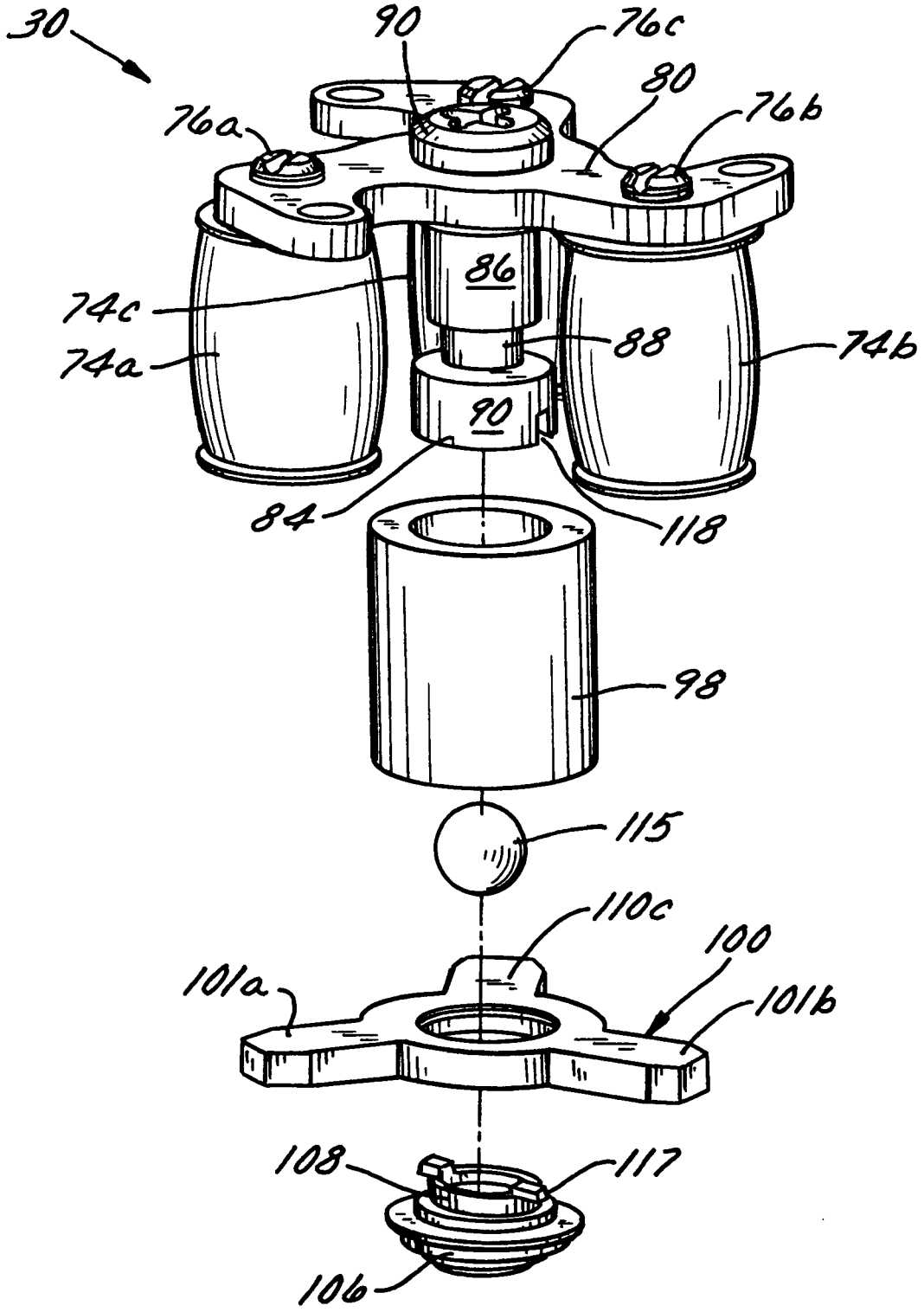
FIG. 3 is an exploded perspective view showing a drive assembly of FIG. 2 in greater detail.

Referring now also to FIG. 3, the drive assembly 30 is shown in greater detail. The drive assembly 30 further comprises a one-piece post member 84 which includes a fitting 86, an intermediate member 88, and a flattened cylindrical region 90. The fitting 86 is a threaded fitting and receives a bolt 96 that mounts the post member 84 to the coil plate 80. A cylindrical permanent magnet 98 fits over the post member 84 in between the coils 74. The flattened cylindrical region 90 has a cavity 99 formed therein (see FIG. 4) which opens out downwardly toward an actuator plate 100.

The actuator plate 100 defines a plane for the switch 25, which herein is referred to as a horizontal plane. Horizontal is defined relative only to the switch 25 itself, of course, because in outer space the switch could be oriented in any direction. Herein, the vertical direction is the direction that is defined by an axis that is substantially normal or perpendicular to the plane defined by the actuator plate 100. The vertical direction remains fixed even though the actuator plate 100 pivots in operation, as discussed below.

The central region of the actuator plate 100 is generally circular in shape and generally matches the shape of the bottom surface of the permanent magnet 98. This shape is preferred because it is optimized for the magnetic retention of the actuator plate 100 against the permanent magnet 98, as discussed below.

Figure 4:
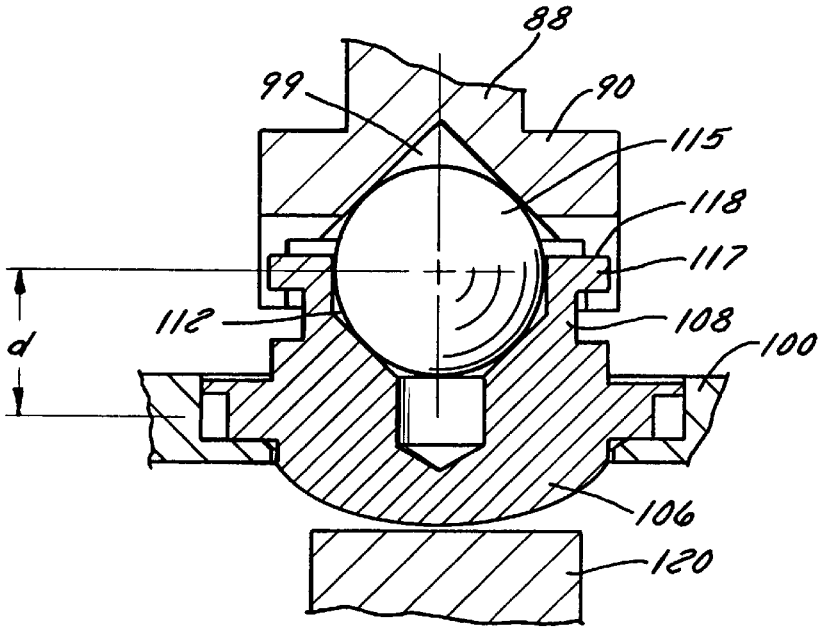
FIG. 4 is a side sectional view showing a portion of the microwave switch of FIG. 2 in greater detail.

Referring now also to FIG. 4, the cavity 99 formed in the flattened cylindrical region 90 is shown. FIG. 4 is a cross sectional view of a portion of the flattened cylindrical region 90, a portion of the actuator plate 100 and a fitting 106. In assembled form, the fitting 106 fits up within the actuator plate 100 such that a top surface 108 protrudes from the top of the actuator plate 100 (see FIG. 2).

The fitting 106 includes a cavity 112 which opens out upwardly towards the cavity 99 in the flattened cylinder 90. A bearing 115 defines a pivot point about which the actuator plate 100 pivots, as described in greater detail below. As shown in FIG. 4, the center of the bearing 115 is spaced from the center of the actuator plate 100 by a distance d. The fitting 106 includes keys 117 which fit within slots 118 on the flattened cylinder 90 to prevent rotational motion of the fitting 106, and therefore the actuator plate 100, relative to the coil plate 80 and therefore the base 50 (see also FIG. 3).

FIG. 4 also illustrates an optional lower surface 120 which is not illustrated in FIG. 2. The purpose of the surface 120 is to prevent high g-forces from irreparably dislodging the actuator plate 100 from the remainder of the drive assembly 30. Thus, for example, if the microwave switch is incorporated into a satellite, launch of the satellite into space will cause high g-forces which cause the actuator plate 100 to move downwardly. Although some vertical movement is permitted by virtue of the fact that the surface 120 is spaced from the bottom of the fitting 106, the surface 120 nevertheless limits the movement of the actuator plate 100 so that the actuator plate 100 is not permanently dislodged. Once the satellite is in orbit, and the switch 25 begins normal operation, the surface 120 is not utilized.

Returning to FIG. 2, the microwave switch also includes a plurality of movable links 125*a*, 125*b* and 125*c* which are associated with arms 101*a*, 101*b* and 101*c* of the actuator plate 100. The links 125*a*–125*c* are hinged and comprise respective pins 127*a*–127*c* which fit within slots 129*a*–129*c* formed in the upper portion 51 of the base 50. As will be detailed below, the links 125 mechanically couple the arms 101 of the actuator plate to the reeds 14 and 16, such that movement of one of the links 125 causes movement of a corresponding pair of reeds 14 and 16.

Figure 5:
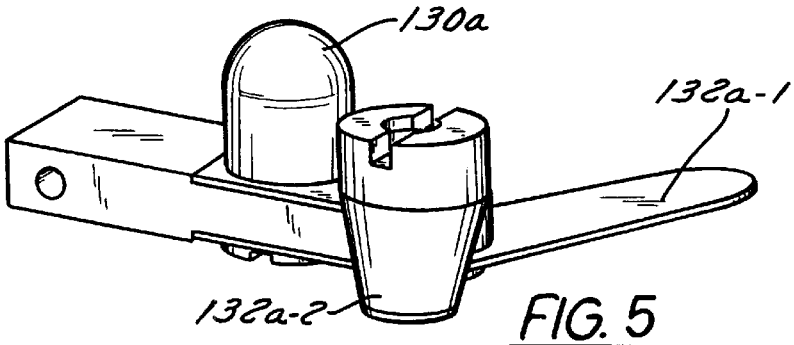
FIG. 5 is a perspective view showing a hinged link of FIG. 2 in greater detail.

Referring now to FIG. 5, an exemplary hinged link 125*a* is illustrated in greater detail. The hinged link 125*a* includes a domed member 130*a* that is disposed beneath the corresponding arm 101*a* of the actuator plate 100. The hinged link 125*a* also comprises a pair of hockey stick-shaped members 132*a*-1 and 132*a*-2, which are generally flat and horizontal and which are disposed at different vertical levels relative to the base 50. The hockey stickshaped members 132*a*-1, 132*b*-1 and 132*c*-1 for the different hinged links 125 are at the same level, as are the hockey stick-shaped members 132*a*-2, 132*b*-2 and 132*c*-2.

Figure 6:
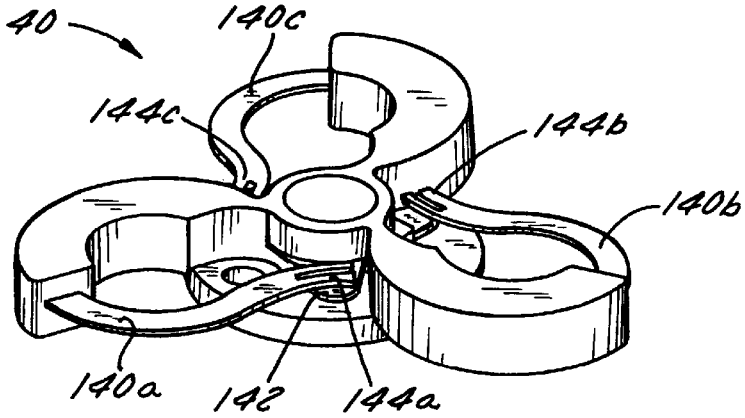
FIG. 6 is a perspective view showing an indicator assembly of FIG. 2 in greater detail.

Referring now to FIG. 6, the indicator assembly 40 is shown in greater detail. The indicator assembly 40 comprises three movable contacts 140*a*, 140*b* and 140*c* and one stationary contact 142 with three evenly spaced contact areas 144*a*, 144*b* and 144*c*. As previously noted, the indicator assembly is used for telemetry so that the position of the switch 25 may be determined electronically.

Referring back to FIG. 2, the operation of the microwave switch 25 will now be described. In all three positions of the switch 25, the actuator plate 100 is held in place vertically substantially exclusively by the magnetic force of the permanent magnet 98 and by opposing contact with a remaining portion of the switch (in FIG. 2, the bearing 115 as well as the bottom surfaces of the cores 76). The permanent magnet 98 attracts the actuator plate 100 toward the permanent magnet 98, such that the attractive holding force of the permanent magnet 98 and the opposing contact locks the actuator plate in place. The opposing contact with the remaining portion of the switch generates a force in the vertical direction that is equal and opposite to the holding force of the permanent magnet, but this force is produced only in reaction to the force of the permanent magnet and is not itself a holding force. The magnetic force of the permanent magnet 98 is thus the only holding force that holds the actuator plate in place in the vertical direction and, without the holding force of the permanent magnet 98, there is nothing to press the actuator plate 100 against the cores 76 and the bearing 115, or to otherwise lock the actuator plate 100 in place in the vertical direction. The attractive holding force of the permanent magnet 98 is therefore required to hold the actuator plate 100 in place.

In operation, the coils 74 are selectively energized in order to choose one of the positions of the switch 25. One of the coils 74 is energized at a time, and the energized coil is energized so as to have a magnetic field that has the same polarity as the magnetic field of the permanent magnet 98.

Assuming, for example, that the coil 74*b* is energized, then a repulsive force is developed between the lower end of the coil 74*b* and the arm 101*b* of the actuator plate 100, which is magnetically coupled to the bottom of the permanent magnet 98. At the same time, an attraction force is developed between the bottom of the remaining two arms 101*a* and 101*c* and the corresponding cores 76*a* and 76*c* (which are magnetically coupled to the top of the permanent magnet by way of the cores themselves and the coil plate 80). As a result, the arms 101*a* and 101*c* are pulled upwardly and into a resting position against the bottom of the cores 76*a* and 76*c* whereas the arm 101*b* is pushed downwardly against the domed shaped member 130*b* of the hinged link 125*b*. The actuator plate 100 therefore pivots about the bearing 100 depending on which coils are energized.

Figure 7A:
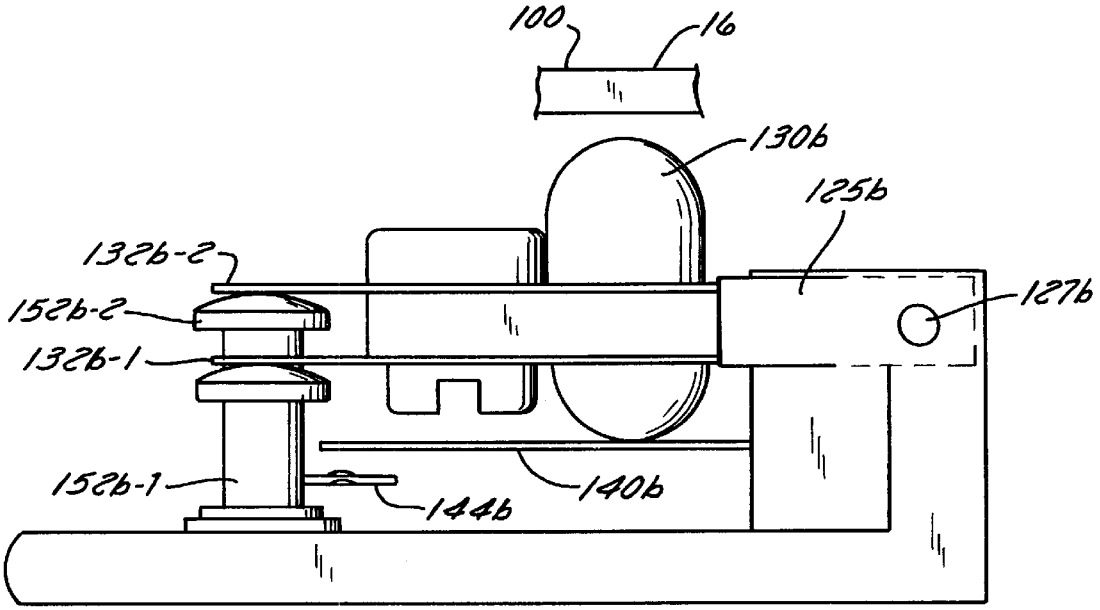
FIGS. 7A–7B show the operation of the microwave switch of FIG. 2 in greater detail.
Figure 7B:
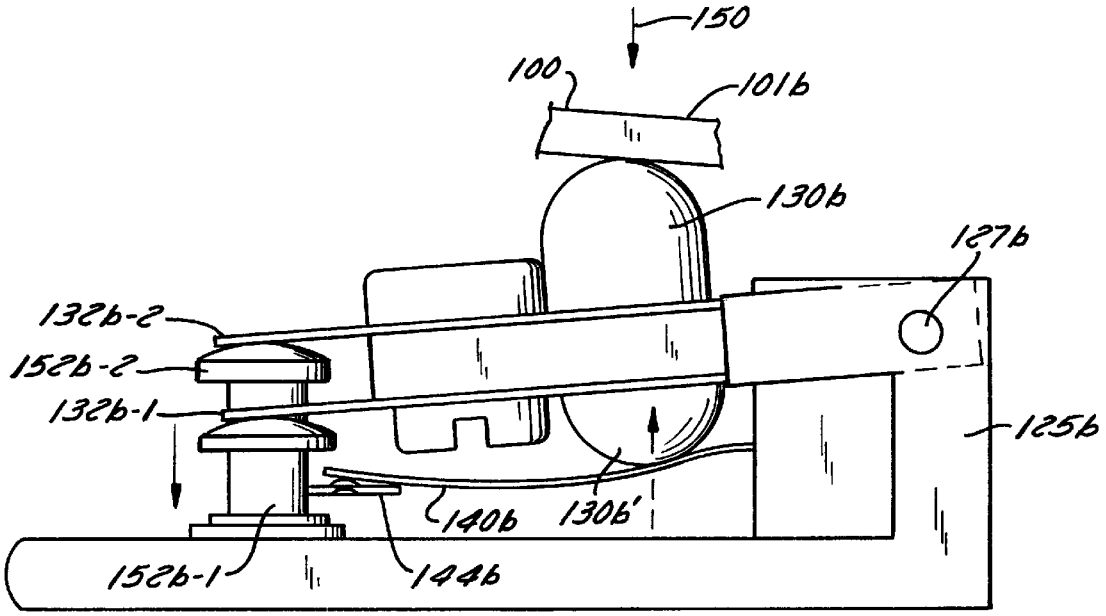

Referring now also to FIGS. 7A–7B, the operation of the hinged link 125*b* is illustrated. FIG. 7A shows the hinged link 125*b* in its unactuated position. FIG. 7B shows the hinged link 125*b* in its actuated position. When the downward pressure from the arm 101*b* (shown with an arrow 150 in FIG. 7B) is applied to the dome-shaped member 130*b*, the hinged link 125*b* is urged downwardly and the hockey sticks 130*b*-1 and 130*b*-2 depress pushers 152*b*-1 and 152*b*-2 which extend through holes in the upper portion 51 of the base 50. In turn, the pushers 152*b*-1 and 152*b*-2 push downwardly against the reeds 16*b* and 14*b*, respectively. As a result, the reed 16*b* is pushed into contact with the contacts 12-1 and 12-3 and the reed 14*b* is pushed into contact with the contacts 12-2 and 12-4.

With respect to the indicator section 42*b*, when the hinged link 125*b* is urged downwardly, pressure is applied to the movable contact 140*b* by a bottom portion 130*b* of the dome-shaped member 130*b*. The bottom portion 130*b* of the dome shaped member 130*b* can be seen only in FIGS. 7A–7B, and has not been shown in FIG. 2. Preferably, all three dome-shaped members 130 have such bottom structures, especially if an indicator assembly is utilized.

When bottom portion 130*b* of the dome-shaped member 130*b* applies pressure to the movable contact 140*b*, the movable contact 140*b* is placed into contact with the contact area 144*b*. This completes an electrical circuit between the movable contact 140*b* and the contact area 144*b*, and the continuity of this circuit can be tested through the use of connection wires (not illustrated) the movable contact 140*b* and the contact area 144*b*. With two additional connection wires (not illustrated) connected to the movable contacts 140*a* and 140*c*, it is possible to determine the position of the switch 25 by testing which one of the three circuits is closed.

When a different coil is energized, the actuator plate 100 shifts to a new position in which two of the three arms 101 abut the corresponding two cores 76, and the remaining arm 101 depresses one of the domed-shaped members 130. In the two remaining positions, the arms 101*a* and 101*c* push down against the dome-shaped members 130*a* and 130*c*, respectively, thereby pushing the reeds 14*a*, 16*a* and 14*c*, 16*c* into contact with the contacts 12 in the same manner as previously described. Therefore, by energizing different coils, the actuator plate 100 can therefore be made to move three different positions (one at a time) that correspond to the three different positions of the connection assembly 53.

It may be noted that it is also possible to obtain the same type of movement of the actuator plate 100 by using different schemes for energizing the coils 74, including energizing multiple coils at once. However, the scheme described above is preferred because of its simplicity.

It is also possible to apply the invention to microwave switches other than microwave T-switches. For example, the invention may be applied to three position microwave switches in which only a single reed is actuated in each position, and to microwave positions that have less than or more than three positions.

Many other changes and modifications may be made to the present invention without departing from the spirit thereof. The scope of these and other changes will become apparent from the appended claims.

I claim:

1. A microwave switch comprising:

(A) a connection assembly, said connection assembly having first, second and third positions, and said connection assembly including (1) a first contact, (2) a second contact, (3) a third contact, (4) a first reed, said first reed being connected to said first contact when said connection assembly is in said first position and being disconnected from said first contact when said connection assembly is in said second and third positions, (5) a second reed, said second reed being connected to said second contact when said connection assembly is in said second position and being disconnected from said second contact when said connection assembly is in said first and third positions, and (6) a third reed, said third reed being connected to said third contact when said connection assembly is in said third position and being disconnected from said third contact when said connection assembly is in said first and second positions; and (B) a drive assembly, said drive assembly including (1) a plurality of electromagnetic coils, (2) a permanent magnet, and (3) an actuator plate, said actuator plate having first, second and third positions that correspond to said first, second and third positions of said connection assembly, said actuator plate being mechanically coupled to said first, second and third reeds and actuating a selected one of said first, second and third reeds so as to place said connection assembly in a selected one of said first, second and third positions at a time, and said actuator plate being placed into one of said first, second and third positions at a time by said plurality of electromagnetic coils and said permanent magnet; and wherein said actuator plate defines a plane and wherein a normal axis is defined by an axis that is substantially perpendicular to said plane;

wherein, during operation of said switch, a magnetic force of said permanent magnet is substantially the only holding force that holds said actuator plate in place in said normal direction, such that said magnetic force of said permanent magnet is required to hold said actuator plate in place in said normal direction.

2. A microwave switch as defined in claim 1, wherein said actuator plate is mechanically coupled to said first, second and third reeds by way of first, second and third movable links, respectively.

3. A microwave switch as defined in claim 2, wherein said actuator plate is generally flat and comprises first, second and third arms that extend substantially parallel to said plane defined by said actuator plate.

4. A microwave switch as defined in claim 3, wherein, in said first position of said actuator plate, said first arm presses on said first movable link, causing said first movable link to press said first reed into contact with said first contact, wherein, in said second position of said actuator plate, said second arm presses on said second movable link, causing said second movable link to press said second reed into contact with said second contact, wherein, in said third position of said actuator plate, said third arm presses on said third movable link, causing said third movable link to press said third reed into contact with said third contact.

5. A microwave switch as defined in claim 1, wherein said microwave switch is a microwave T-switch.

6. A microwave switch as defined in claim 5, wherein said actuator plate is mechanically coupled to said first, second and third reeds by way of first, second and third movable links, respectively.

7. A microwave switch as defined in claim 6, wherein each said movable link comprises first and second generally flat members that extend generally parallel to said plane, and wherein, for each respective one of said movable links, said first member is spaced from said actuator plate by a different amount than said second member.

8. A microwave switch as defined in claim 7, wherein each of said first members for each of said movable links are spaced from said actuator plate by approximately the same amount; and wherein each of said second members for each of said movable links are spaced from said actuator plate by approximately the same amount.

9. A microwave switch as defined in claim 8, wherein each of said first and second members has substantially the shape of a hockey stick.

10. A microwave switch as defined in claim 1, wherein said drive assembly includes a bearing that is disposed between said actuator plate and said permanent magnet, and wherein, to move between said first, second and third positions, said actuator plate pivots about said bearing.

11. A microwave switch as defined in claim 1, wherein said permanent magnet is the only permanent magnet used by said drive assembly.

12. A microwave T-switch comprising:

(A) a connection assembly, said connection assembly having first, second and third positions, and said connection assembly including (1) a first contact, (2) a second contact, (3) a third contact, (4) a fourth contact, (5) a first reed, said first reed being connected to said first and second contacts when said connection assembly is in said first position and being disconnected from said first and second contacts when said connection assembly is in said second and third positions, (6) a second reed, said second reed being connected to said second and fourth contacts when said connection assembly is in said second position and being disconnected from said second and fourth contacts when said connection assembly is in said first and third positions, and (7) a third reed, said third reed being connected to said first and fourth contacts when said connection assembly is in said third position and being disconnected from said first and fourth contacts when said connection assembly is in said first and second positions, (8) a fourth reed, said fourth reed being connected to said third and fourth contacts when said connection assembly is in said first position and being disconnected from said third and fourth contacts when said connection assembly is in said second and third positions, (9) a fifth reed, said fifth reed being connected to said first and third contacts when said connection assembly is in said second position and being disconnected from said first and third contacts when said connection assembly is in said first and third positions, and

(10) a sixth reed, said sixth reed being connected to said second and third contacts when said connection assembly is in said third position and being disconnected from said second and third contacts when said connection assembly is in said first and second positions; and (B) a drive assembly, said drive assembly including (1) a plurality of electromagnetic coils, (2) a permanent magnet, and (3) an actuator plate, said actuator plate having first, second and third positions that correspond to said first, second and third positions of said connection assembly, said actuator plate being mechanically coupled to said first, second and third reeds and actuating a selected one of said first, second and third reeds so as to place said connection assembly in a selected one of said first, second and third positions at a time, and said actuator plate being placed into one of said first, second and third positions at a time by said plurality of electromagnetic coils and said permanent magnet; and wherein said actuator plate defines a plane and wherein a normal axis is defined by an axis that is substantially perpendicular to said plane;

wherein, during operation of said switch, a magnetic force of said permanent magnet is substantially the only holding force that holds said actuator plate in place in said normal direction, such that said magnetic force of said permanent magnet is required to hold said actuator plate in place in said normal direction.

13. A microwave T-switch as defined in claim 12, wherein said actuator plate is mechanically coupled to said first, second and third reeds by way of first, second and third movable links, respectively.

14. A microwave switch as defined in claim 13, wherein said actuator plate is generally flat and comprises first, second and third arms that extend substantially parallel to said plane defined by said actuator plate.

15. A microwave switch as defined in claim 14, wherein, in said first position of said actuator plate, said first arm presses on said first movable link, causing said first movable link to press said first reed into contact with said first contact, wherein, in said second position of said actuator plate, said second arm presses on said second movable link, causing said second movable link to press said second reed into contact with said second contact, wherein, in said third position of said actuator plate, said third arm presses on said third movable link, causing said third movable link to press said third reed into contact with said third contact.

16. A microwave switch as defined in claim 13, wherein each said movable link comprises first and second generally flat members that extend generally parallel to said plane, and wherein, for each respective one of said movable links, said first member is spaced from said actuator plate by a different amount than said second member.

17. A microwave switch as defined in claim 16, wherein each of said first members for each of said movable links are spaced from said actuator plate by approximately the same amount; and wherein each of said second members for each of said movable links are spaced from said actuator plate by approximately the same amount.

18. A microwave switch as defined in claim 12, wherein said drive assembly includes a bearing that is disposed between said actuator plate and said permanent magnet, and wherein, to move between said first, second and third positions, said actuator plate pivots about said bearing.

19. A microwave switch as defined in claim 12, wherein said permanent magnet is the only permanent magnet used by said drive assembly.

20. A microwave switch comprising:

(A) a connection assembly, said connection assembly having first, second and third positions, and said connection assembly including (1) a first contact, (2) a second contact, (3) a third contact, (4) a first reed, said first reed being connected to said first contact when said connection assembly is in said first position and being disconnected from said first contact when said connection assembly is in said second and third positions, (5) a second reed, said second reed being connected to said second contact when said connection assembly is in said second position and being disconnected from said second contact when said connection assembly is in said first and third positions, and (6) a third reed, said third reed being connected to said third contact when said connection assembly is in said third position and being disconnected from said third contact when said connection assembly is in said first and second positions; and (B) a drive assembly, said drive assembly including (1) a plurality of electromagnetic coils, (2) a permanent magnet, and (3) an actuator plate, said actuator plate comprising first, second and third arms that extend substantially parallel to said plane defined by said actuator plate, said actuator plate having first, second and third positions that correspond to said first, second and third positions of said connection assembly, said actuator plate being mechanically coupled to said first, second and third reeds and actuating a selected one of said first, second and third reeds so as to place said connection assembly in a selected one of said first, second and third positions at a time, and said actuator plate being placed into one of said first, second and third positions at a time by said plurality of electromagnetic coils and said permanent magnet;

(4) first, second and third movable links, said first, second and third movable links mechanically coupling said first, second and third arms of said actuator plate to said first, second and third reeds, respectively, wherein each said movable link comprises first and second generally flat members that extend generally parallel to said plane, wherein, for each respective one of said movable links, said first member is spaced from said actuator plate by a different amount than said second member, wherein each of said first members for each of said movable links are spaced from said actuator plate by approximately the same amount, and wherein each of said second members for each of said movable links are spaced from said actuator plate by approximately the same amount;

wherein said actuator plate defines a plane and wherein a normal axis is defined by an axis that is substantially perpendicular to said plane;

wherein, during operation of said switch, said actuator plate is held in place in said normal direction substantially exclusively by a magnetic force of said permanent magnet and by opposing contact with said switch, such that said magnetic force of said permanent magnet is required to hold said actuator plate in place in said normal direction;

wherein, in said first position of said actuator plate, said first arm presses on said first movable link, causing said first movable link to press said first reed into contact with said first contact, wherein, in said second position of said actuator plate, said second arm presses on said second movable link, causing said second movable link to press said second reed into contact with said second contact;

wherein, in said third position of said actuator plate, said third arm presses on said third movable link, causing said third movable link to press said third reed into contact with said third contact;

wherein said drive assembly includes a bearing that is disposed between said actuator plate and said permanent magnet; and wherein, to move between said first, second and third positions, said actuator plate pivots about said bearing.

21. A microwave switch comprising:

(A) a connection assembly, said connection assembly having first, second and third positions, and said connection assembly including (1) a first contact, (2) a second contact, (3) a third contact, (4) a first reed, said first reed being connected to said first contact when said connection assembly is in said first position and being disconnected from said first contact when said connection assembly is in said second and third positions, (5) a second reed, said second reed being connected to said second contact when said connection assembly is in said second position and being disconnected from said second contact when said connection assembly is in said first and third positions, and (6) a third reed, said third reed being connected to said third contact when said connection assembly is in said third position and being disconnected from said third contact when said connection assembly is in said first and second positions; and (B) a drive assembly, said drive assembly including (1) a plurality of electromagnetic coils, (2) a permanent magnet, and (3) an actuator plate, said actuator plate having first, second and third positions that correspond to said first, second and third positions of said connection assembly, said actuator plate being mechanically coupled to said first, second and third reeds and actuating a selected one of said first, second and third reeds so as to place said connection assembly in a selected one of said first, second and third positions at a time, and said actuator plate being placed into one of said first, second and third positions at a time by said plurality of electromagnetic coils and said permanent magnet; and (4) first, second and third movable links, said first, second and third movable links mechanically coupling said first, second and third arms of said actuator plate to said first, second and third reeds, respectively, wherein each said movable link comprises first and second generally flat members that extend generally parallel to said plane, wherein, for each respective one of said movable links, said first member is spaced from said actuator plate by a different amount than said second member, wherein each of said first members for each of said movable links are spaced from said actuator plate by approximately the same amount, and wherein each of said second members for each of said movable links are spaced from said actuator plate by approximately the same amount.

* * * * *